US007082784B2

(12) United States Patent
Roth et al.

(10) Patent No.: US 7,082,784 B2
(45) Date of Patent: Aug. 1, 2006

(54) METHOD AND SYSTEM FOR USE WITH A CONSUMABLE BEVERAGE

(76) Inventors: Hank Roth, 42 Tremont St., Duxbury, MA (US) 02332; Donna Roth, 42 Tremont St., Duxbury, MA (US) 02331

( * ) Notice: Subject to any disclaimer, the term of this patent is extended or adjusted under 35 U.S.C. 154(b) by 0 days.

(21) Appl. No.: 10/444,654

(22) Filed: May 23, 2003

(65) Prior Publication Data

US 2003/0196448 A1 Oct. 23, 2003

Related U.S. Application Data

(60) Continuation of application No. 10/212,976, filed on Aug. 5, 2002, now Pat. No. 6,584,800, which is a division of application No. 10/128,022, filed on Apr. 23, 2002, now Pat. No. 6,494,056.

(51) Int. Cl.
*F25D 3/08* (2006.01)

(52) U.S. Cl. ..... 62/457.2; 62/457.3; 62/457.9; 222/23.87

(58) Field of Classification Search ..... 62/457.2, 62/457.3, 457.4, 457.9; 220/506, 508, 23.83, 220/23.85, 23.87, 23.89
See application file for complete search history.

(56) References Cited

U.S. PATENT DOCUMENTS

| | | | | | |
|---|---|---|---|---|---|
| 407,946 | A | * | 7/1889 | Vaughn | 194/273 |
| 4,732,303 | A | | 3/1988 | Wang | |
| 5,009,083 | A | | 4/1991 | Spinos | |
| 5,065,909 | A | | 11/1991 | Pino et al. | |
| 5,085,336 | A | | 2/1992 | Lynd | |
| 5,129,238 | A | | 7/1992 | Schwartz et al. | |
| 5,242,079 | A | | 9/1993 | Stephens et al. | |
| D351,761 | S | | 10/1994 | Feer | |
| 5,456,090 | A | | 10/1995 | McCoy | |
| 5,507,156 | A | | 4/1996 | Redmon | |
| 5,597,087 | A | | 1/1997 | Vinarsky | |
| 5,609,039 | A | | 3/1997 | Green et al. | |
| 5,609,090 | A | | 3/1997 | Weyer | |
| D382,170 | S | | 8/1997 | Green | |
| D384,584 | S | | 10/1997 | Kong | |
| D387,621 | S | | 12/1997 | Sullivan et al. | |
| D389,365 | S | | 1/1998 | Lipson | |
| D401,106 | S | | 11/1998 | Valentinitsch | |
| D408,220 | S | | 4/1999 | Chomik | |
| 5,984,141 | A | * | 11/1999 | Gibler | 222/80 |
| 5,992,702 | A | * | 11/1999 | Shapiro | 222/205 |
| 6,006,952 | A | * | 12/1999 | Lucas | 222/211 |
| 6,050,433 | A | | 4/2000 | Russell | |
| 6,123,065 | A | | 9/2000 | Teglbjarg | |
| 6,161,777 | A | * | 12/2000 | Carter et al. | 239/222.11 |
| 6,179,146 | B1 | * | 1/2001 | Betras | 220/23.4 |
| 6,224,922 | B1 | * | 5/2001 | Fonte | 426/115 |
| D448,971 | S | | 10/2001 | Hughes | |
| 6,415,624 | B1 | * | 7/2002 | Connors et al. | 62/457.3 |
| 6,494,332 | B1 | * | 12/2002 | Haughton et al. | 215/355 |

FOREIGN PATENT DOCUMENTS

JP 2000238822 A * 9/2000

OTHER PUBLICATIONS

One sheet of drawings identified as "Views of Older Product Which Constitutes Prior Art".

* cited by examiner

*Primary Examiner*—William E Tapolcai
*Assistant Examiner*—Mohammad M. Ali
(74) *Attorney, Agent, or Firm*—Garcia-Zamor IP Law; Ruy M. Garcia-Zamor

(57) ABSTRACT

A system for use with a consumable beverage includes a container having a mouth. A lid is detachably engaged with the container. A collar is adapted to be seated in the mouth of the container. The collar defines an opening therein. A thermal energy storing member is detachably engagable with the opening in the collar and/or the lid. A collar for supporting an end of a thermal energy storing member; a lid for a container adapted to engage a thermal energy storing member; and method of providing a chilled consumable beverage are each separately detailed herein.

24 Claims, 3 Drawing Sheets

FIG. 1
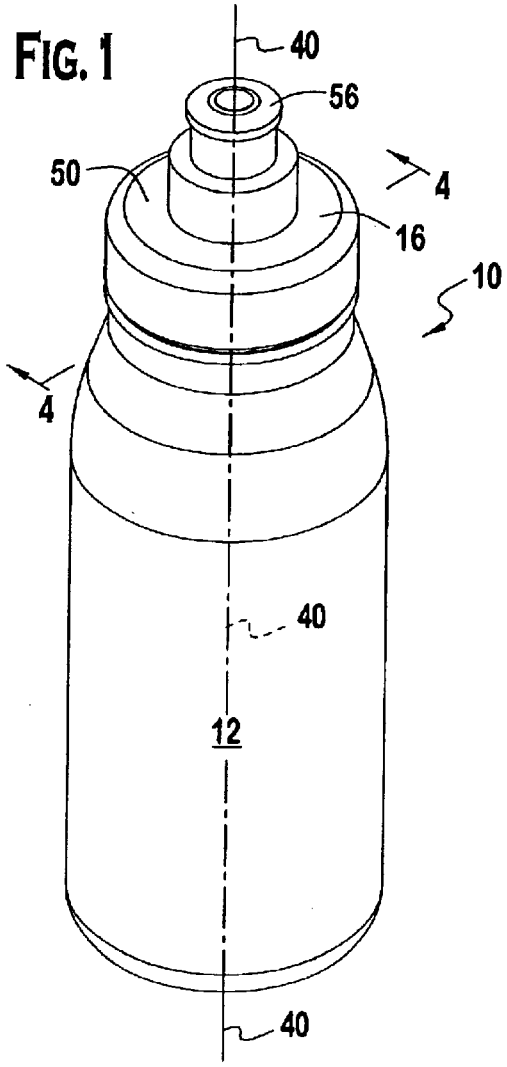
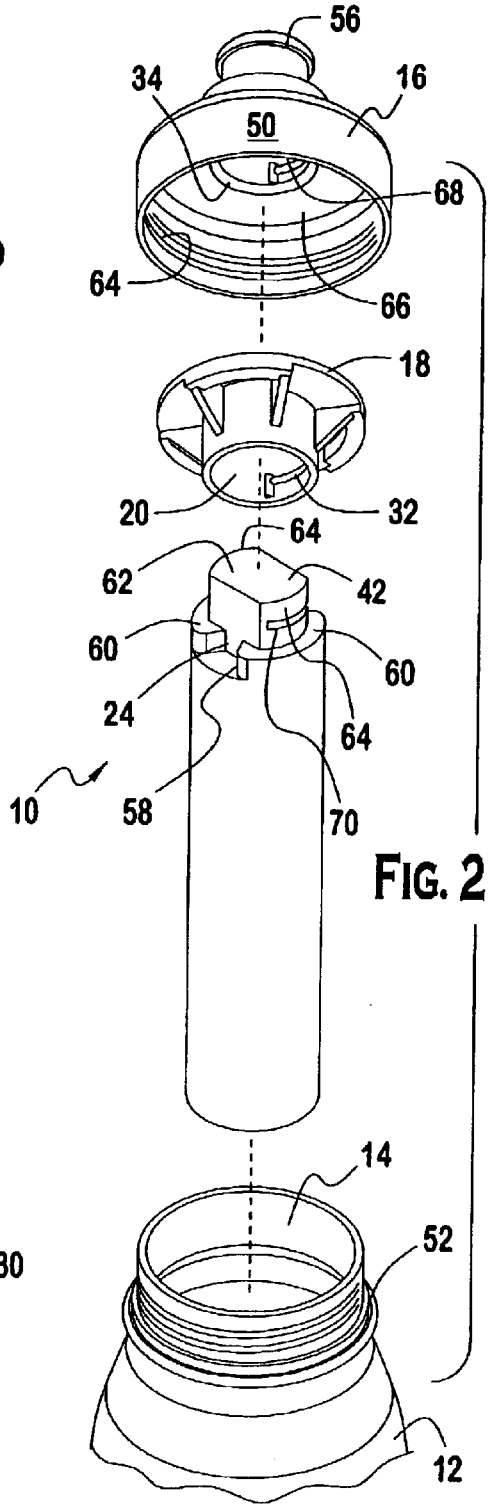
FIG. 2
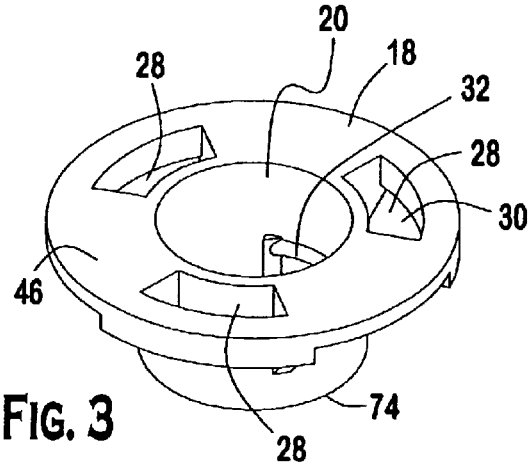
FIG. 3

FIG. 4
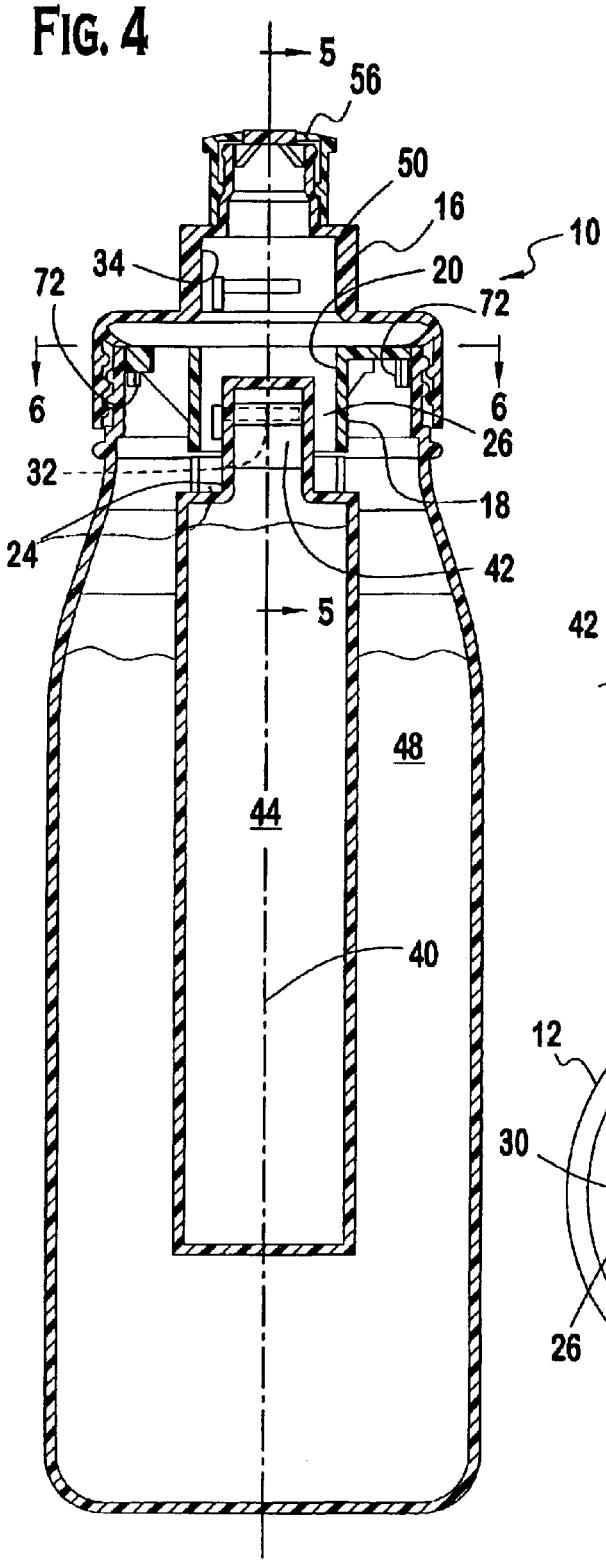
FIG. 5
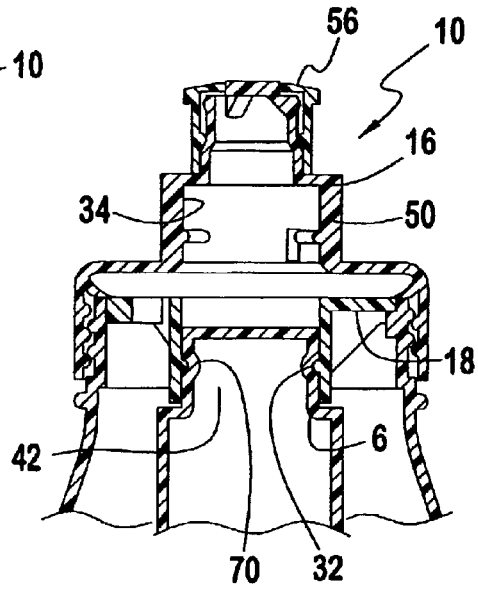
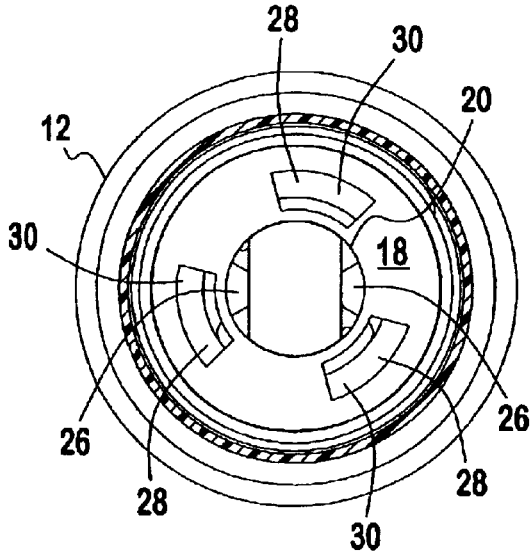
FIG. 6

FIG. 7
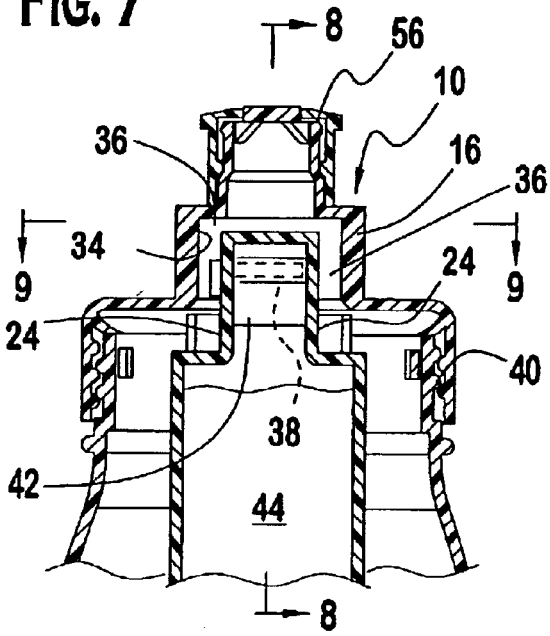
FIG. 8
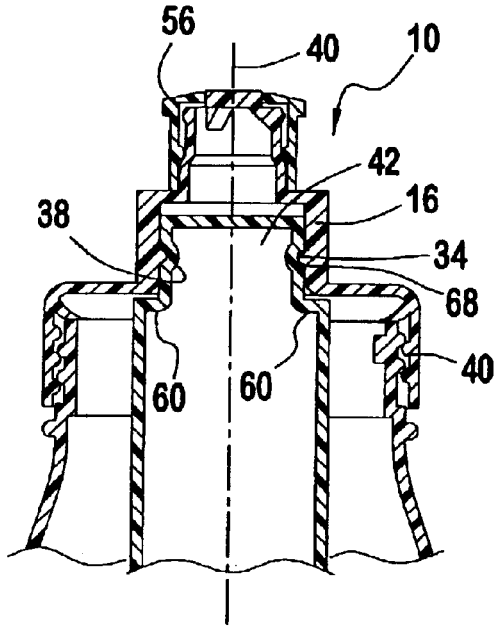
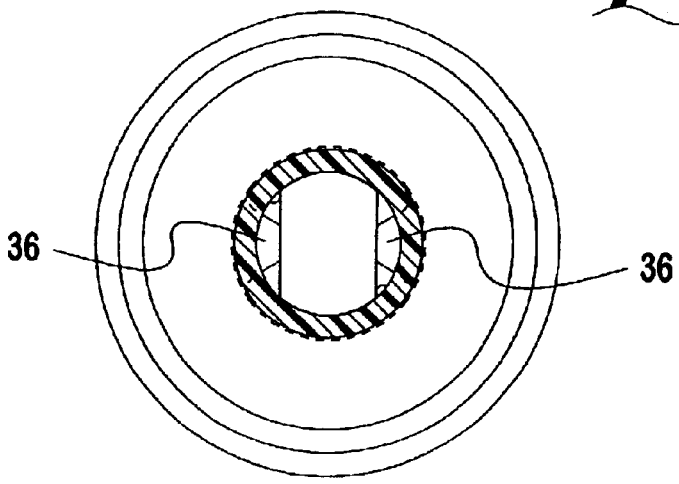
FIG. 9

METHOD AND SYSTEM FOR USE WITH A CONSUMABLE BEVERAGE

CROSS REFERENCE TO RELATED APPLICATIONS

This application claims priority to and is a continuation of: U.S. patent application Ser. No. 10/128,022, entitled "Method and System for use with a Consumable Beverage", filed on Apr. 23, 2002, now U.S. Pat. No. 6,494,056; and also claims priority to and is a continuation of U.S. application Ser. No. 10/212,976, "Method and System for use with a Consumable Beverage", filed on Aug. 5, 2002 now U.S. Pat. No. 6,584,800; both of the above-identified applications are hereby incorporated by reference herein as if fully set forth in their entirety.

BACKGROUND

The present invention is directed to devices and methods for enhancing the quality of consumable beverages and, more specifically, to a system for use with a consumable beverage and a method of providing a chilled consumable beverage. Beverages are typically chilled using ice cubes to maintain a desired beverage temperature. However, the use of ice cubes results in the dilution of the beverage due to the introduction of water resulting from the melting of ice cubes. Additionally, some people will spill beverages or find filled beverage bottles to be unwieldy due to a sudden shift in the bottle's center of mass caused by unexpected movement of ice cubes when the beverage container is tilted.

To overcome this difficulty, re-freezable inserts have been developed for use with drink bottles. These re-freezable inserts can be placed in drink bottles to maintain a beverage in a chilled condition. However, a method for satisfactorily securing a re-freezable insert in a drink bottle has not been developed.

Clearly, what is needed is a method and system for use with a consumable beverage that securely mounts a thermal energy storing member within a container; that preferably mounts the thermal energy storing member to either a collar or a lid of the container; that preferably incorporates an easy to operate twist lock connection for securing the thermal energy storing member; that preferably allows easy removal of the thermal energy storing member without requiring the removal of other system components; and that is that fun and easy to use by children.

SUMMARY

One embodiment of the present invention is directed to a system for use with a consumable beverage. The system includes a container having a mouth. A lid is detachably engagable with the container. A collar is adapted to be seated in the mouth of the container. The collar defines an opening therein. A thermal energy storing member is detachably engagable with the opening in the collar and/or the lid.

A separate embodiment of the present invention is directed to a collar for supporting an end of a thermal energy storing member proximate to the mouth of a consumable beverage container. The collar includes a body configured to complement a shape of the mouth. The body defines an opening therethrough. The opening is adapted to engage the end of the thermal energy storing member.

A separate embodiment of the present invention is directed to a lid for a container adapted to engage a thermal energy storing member. The lid includes a body adapted to engage the container and having an inner surface. The inner surface is adapted to receive at least a portion of the thermal energy storing member therein. The inner surface is adapted to form, in combination with the thermal energy storing member, a liquid passageway along the thermal energy storing member and through the body.

A separate embodiment of the present invention is directed to a method of providing a chilled consumable beverage. The method includes: providing a container having a mouth; placing a consumable beverage in the container; chilling a thermal energy storing member; and inserting the chilled thermal energy storing member into the container such that the chilled energy storing member contacts the consumable beverage to cool to the consumable beverage within the container, the chilled energy storing member being securely positionable within the container via a collar seated proximate to the mouth of the container.

A separate embodiment of the present invention is directed to a system for use with a consumable beverage. The system includes a container having a mouth. A lid detachably engagable with the container. A thermal energy storing member detachably engagable with the lid via a twist lock mechanism.

BRIEF DESCRIPTION OF THE SEVERAL VIEWS OF THE DRAWINGS

The foregoing summary, as well as the following detailed description of the preferred embodiment of the present invention will be better understood when read in conjunction with the appended drawings. For purposes of illustrating the invention, there are shown in the drawings, an embodiment which is presently preferred. It is understood, however, that the invention is not limited to the precise arrangement and instrumentality shown. In the drawings:

FIG. 1 is a perspective view of a system for use with a consumable beverage according to the preferred embodiment of the present invention;

FIG. 2 is an exploded partial view of the system of FIG. 1 illustrating a lid, a collar, a thermal energy storing member, and a top of a container;

FIG. 3 is an enlarged perspective view of the collar of FIG. 2;

FIG. 4 is a cross-sectional view of the system of FIG. 1 as taken along the line 4—4 of FIG. 1 illustrating the thermal energy storing member secured in an opening in the collar;

FIG. 5 is a cross-sectional view of the system of the FIG. 4 as taken along the line 5—5 of FIG. 4 illustrating the engagement between the thermal energy storing member and a thread within the opening in the collar;

FIG. 6 is a cross-sectional view of the system of FIG. 4 as taken along the line 6—6 of FIG. 4 and illustrates a top plan view of the combination collar and thermal energy storing member when seated within the mouth of the container;

FIG. 7 is a view similar to that of FIG. 5 illustrating the system of FIG. 4 with the collar removed so that the thermal energy storing member directly engages the lid;

FIG. 8 is a cross-sectional view of the system of FIG. 7 as taken along the line 8—8 of FIG. 7 illustrating the engagement between the thermal energy storing member and a thread within the lid; and FIG. 9 is a cross-sectional view of the system of FIG. 7 as taken along the line 9—9 of FIG. 7 illustrating a top plan view of the thermal energy storing member when engaged with a portion of the lid.

DETAILED DESCRIPTION OF THE PREFERRED EMBODIMENT

Certain terminology is used in the following description for convenience only and is not limiting. The words "right," "left," "upper," and "lower" designate directions in the drawings to which reference is made. The words "inwardly" and "outwardly" refer to directions toward and away from, respectively, the geometric center of the system for use with a consumable beverage and designated parts thereof. The terminology includes the words above specifically mentioned, derivatives thereof, and words of similar import. Additionally, the words "a" and "one" are defined as including one or more of the referenced item unless specifically stated otherwise.

Referring to FIGS. 1–9, wherein like numerals indicate like elements throughout, a preferred embodiment of a system for use with a consumable beverage is shown and generally designated as 10. Briefly stated, the system includes a container 10 for enclosing a beverage 48 and a thermal energy storing member 44 therein to maintain the beverage 48 in either a chilled or heated condition. The thermal energy storing member 44 is preferably securable to either one of a collar 18 (further described below) or a lid 16 (further described below) via a convenient twist lock feature that allows the thermal energy member 44 to be easily disengaged from either component so that the remaining portions of the system 10 can used with beverages while the thermal energy storing member 44 is being heated or cooled. Additionally, the system 10 can be used with one of multiple interchangeable thermal energy storing members 44, to avoid delays caused by waiting for a single thermal energy storing member 44 to re-freeze or re-heat prior to continued use of the system 10.

The system 10 and its component parts are preferably formed from a sturdy, non-reactive, durable material, such as a suitable polymer. However, those of ordinary skill in the art will appreciate from this disclosure that the system 10 and its various components can be formed from any materials suitable for use with beverages. The thermal energy storing member 44 preferably contains a gelatinous material that is formed of re-freezable material and/or re-heatable material, such as the non-toxic materials used in gel packs and the like.

Referring to FIGS. 1 and 2, the system 10 for use with a consumable beverage 48 includes a container 12 having a mouth 14. While it is preferred that the container 12 is part of a sports bottle, those of ordinary skill in the art will appreciate from this disclosure that any type of container 12 can be used with the system 10 of the present invention. Similarly, while it is preferred that the mouth 14 of the container 12 is generally circularly shaped, those of ordinary skill in the art will appreciate from this disclosure that the mouth 14 can have any shape without departing from the scope of the present invention.

The container 12 preferably has at least one thread 52 positioned generally around a substantial portion of a perimeter of the container 12 proximate to the mouth 14 for engaging a lid 16. Alternatively, the container 12 can engage the lid 16 via a snap fit without departing from the scope of the present invention.

As best shown in FIG. 4, the lid 16 is preferably detachably engagable with the container 12 by engaging at least one lid thread 54 with the at least one lid thread 52. The least one lid thread 54 generally extends substantially around an inner surface of the lid 16 for detachably engaging the container 12. The lid 16 preferably includes a pull top 56 to allow the container 12 to be sealed when not in use.

As shown in FIGS. 4, 5, 7, and 8, the lid 16 is formed by a lid body 50 that preferably has a tube section 34 for receiving a least a portion of the thermal energy storing member 44 therein. The tube section 34 is preferably generally cylindrical shaped.

The thermal energy storing member 44 can be attached to either one of the lid 16 or the collar 18 (further described below). The connection between the thermal energy storing member 44 and the lid 16 is as follows. Referring to FIGS. 2, 4, and 7, the thermal energy storing member 44 preferably has at least one groove 24 adapted to form, in combination with the tube section 34, a liquid passageway 36 through the lid 16 when the collar 18 is not used with the system 10. Grooves 24 are preferably located on opposing sides of the top end 62 of the thermal energy storing member 44. Each groove 24 preferably extends generally inwardly into the thermal energy storing member to form a flared section 58.

Referring to FIG. 8, when the thermal energy storing member 44 is engaged with the lid 16, a shoulder 60 of the thermal energy storing member 44 preferably abuts, or is proximate to, the bottom end of the tube section 34. The flared section 58 of the groove(s) 24 allows beverage 48 to flow from the inside of the container 12 through the flared section 58 and through tube section 34 (i.e., through the liquid passageway 26).

As best shown in FIGS. 2, 7, and 8 the upper end 62 of the thermal energy storing member 44 preferably has a generally oblong shape to allow opposing ends 64 to engage the inner surface of the tube section 34 while still leaving an opening that forms part of the liquid passageway 26 through which the beverage 48 can flow out of the container 12. Thus, the lid inner surface 66 is adapted to receive at least a portion of the thermal energy storing member 44 and is adapted to form, in combination with the thermal energy storing member 44, the liquid passageway 26 along the thermal energy storing member 44 and through the lid body 50. The routing of the liquid passageway 24 along the thermal energy storing member 44 results in the more efficient cooling (or heating) of the beverage 48 just prior to consumption thereof.

It is preferable that at least one thread 68 is positioned within the tube section 34 to engage the thermal energy storing member 44. The opposing ends 64 of the top portion 62 of the thermal energy storing member 44 preferably have recesses 70 that are complementarily shaped to receive the tube section thread 68 of the lid 16. Thus, the tube section one thread 68 allows the inner surface of the lid 16 to detachably engage the thermal energy storing member 44 using a twist lock mechanism. This allows for quick and secure mounting of the thermal energy storing member 44. Additionally, this secure positioning of the thermal energy storing member avoids excessive shifting of the container's center of mass when the drink bottle is tilted.

As mentioned above, the thermal energy storing member 44 can also be secured to the collar 18. Referring to FIGS. 2-4, the collar 18 is adapted to be seated in the container mouth 14. Supports 72 are preferably positioned on a inner surface of the container 12 proximate to the mouth 14 to brace the bottom side of the collar 18. This allows the collar 18 to be slid inside of the mouth 14 and braced by supports 72 such that the top surface of the collar 18 is generally aligned with the upper edge of the mouth 14. The collar 18 has a body 46 defining an opening 20 therein which is adapted to engage the end 62 of the thermal energy storing member 44. The opening 20 preferably, but not necessarily, has a generally cylindrical shape. The collar body 46 complements the shape of the mouth 14.

The thermal energy storing member 44 preferably has at least one groove 24 adapted to form, in combination with the collar 18, a liquid passageway 24 though the collar 18. Referring to FIG. 5, when the thermal energy storing member 44 is engaged with the collar, the shoulder 60 of the thermal energy storing member 44 preferably abuts, or is located proximate to, the lower edge 74 of the collar 18. The positioning of the groove 24 generally below the shoulder 60 of the thermal energy storing member 44 allows the beverage 48 to pass through the groove 24 underneath the lower edge 74 of the collar 18 and through the liquid passageway 24. As the beverage 48 travels along the thermal energy storing member 44, the beverage 48 is chilled (or heated) to provide enhanced enjoyment to a drinker. The routing of the liquid passageway 24 along the thermal energy storing member 44 results in the more efficient cooling (or heating) of the beverage 48 just prior to consumption thereof.

Referring to FIGS. 3 and 6, the collar 18 preferably defines at least one vent 28 therethrough to create a second liquid passageway 30. The second liquid passageway 30 provides improved beverage flow 48 within the container. The vent(s) 28 is preferably spaced from the thermal energy member 44.

It is preferred that at least one thread 32 is positioned within the collar opening 20 that is adapted to engage the thermal energy storing member 44. The engagement between the collar thread 32 and the recess 70 in the thermal energy storing member 44 allows for a twist lock connection between the thermal energy storing member 44 and the collar that provides a secure placement of the thermal energy storing member 44 within the container 12. This prevents the center of gravity of a full drinking system 10 from suddenly shifting due to the movement of the energy storing member 44 therein. Additionally, the twist lock engagement between the thermal energy storing member 44 and the collar 18 provides for quick and easy removal and replacement of the thermal energy storing member 44 when desired. When the thermal energy storing member 44 is twisted and locked in position relative to the collar 18; the collar 18 is seated generally within the mouth 14 of the container; and the lid 16 is secured over the mouth 14 of the container 12, the energy storing member 44 and the collar 18 are secured in position. Thus, the collar 18 is securable in position when seated in the mouth 14 and the lid 16 is detachably engaged with the container 12.

As is clear from the above description of the engagement between the thermal energy storing member 44 and either the lid 16 or the collar 18, the thermal energy storing member 44 is detachably engagable with the collar 18 and/or the lid 16. It is preferably that the end 62 of the thermal energy storing member 44 that is attached to the collar 18 or the lid 16 is alignable along the longitudinally axis 40 of the container 12.

The present invention also includes a method of providing a chilled consumable beverage. The method includes the steps of providing a container 12 having a mouth 14 and placing a consumable beverage 48 in the container 12. The method also includes chilling a thermal energy storing member 44 and inserting the chilled thermal energy storing member 44 into the container 12 such that the chilled thermal energy storing member 44 contacts the consumable beverage 48 to cool the beverage 48 enclosed within the container 12. The chilled thermal energy storing member 44 is securely positioned within the container 12 via a collar 18 seated proximate to the mouth 14 of the container 12. The method of the present invention preferably includes securing a lid 16 over the mouth 14 that also secures the collar 18 in the seated position and inserting the chilled thermal energy storing member 44 within the opening 20 in the collar 18 such that a liquid passageway 26 along the chilled thermal energy storing member 44 and through the collar 18 is formed. The method of the present invention preferably includes providing a collar 18 having at least one vent 28 therethrough to form a second liquid passageway 30 through the collar 18. The at least one vent 28 is preferably spaced from the opening 20.

Referring to FIGS. 1–9, one embodiment of the system 10 for use with a consumable beverage 48 operates as follows. The lid 16 is removed from the container 12 and the combination collar 18 and thermal energy storing member 44 is removed from the container 12. Once the combination collar 18 and thermal energy storing member 44 are removed from the container 12, the thermal energy storing member 44 is twisted to disengage the recesses 70 from the collar thread 32 to allow to the thermal energy storing member 44 to be separated from the collar Then, the thermal energy storing member 44 is heated or chilled as desired and the container 12 is filled with a consumable beverage 48 and the heated or chilled thermal energy storing member 44 is engaged with one of the collar 18 or the lid 16 to maintain a desired beverage temperature. To attach the thermal energy storing member 44 to the collar 18, the upper end 62 of the thermal energy storing member 44 is inserted into the opening 20 of the collar 18 and twisted to engage the recesses 70 with the collar thread 32. This twist lock feature securely positions the thermal energy storing member 44 relative to the collar 18 and relative to the container 12.

Once the thermal energy storing member 44 is attached to the collar 18, the combination is inserted into the mouth 14 of the container 12 with the underside of the collar 18 resting on supports 72. Then, the lid 16 is secured over the mouth 14 to sandwich the collar 18 in position between the supports 72 and an inner surface of the lid 16.

Alternatively, when the thermal energy storing member 44 is attached to the lid 16, the upper end 62 of the thermal energy storing member 44 is inserted into the tube section 34 of the lid 16 and twisted to engage the recesses 70 with the lid thread 68. Thus, the thermal energy storing member 44 uses the advantageous twist lock securing feature regardless of whether the thermal energy storing member 44 is secured to the collar 18 or to the lid 16.

The liquid passageways formed by the groove 24 of the thermal energy storing member 44 and one of the collar 18 and the lid 16 allow for beverage 48 to flow along the thermal energy storing member 44 toward the pull top 56 of the container 12 and enhances the heat transfer efficiency of the system. Additionally, by securely positioning the thermal energy storing member 44 along the longitudinal axis 40 of the container 12, sudden shifts in the center of gravity of the system 10 due to tilting of the container are reduced. This simplifies the handling of the container 12. Furthermore, the efficient and simple twist lock mechanism for securing the thermal energy storing member 44 allows the cooling (or heating) element of the system 10 to be removed while still allowing the system 10 to be used for drinking. Multiple thermal energy storing members 44 can be used with a single lid 16 and container 12 combination.

It is recognized by those skilled in the art, that changes may be made to the above described embodiment of the invention without departing from the broad inventive concept thereof. It is understood, therefore, that this invention is not limited to the particular embodiment disclosed, but is intended to cover to all modifications which are within the spirit and scope of the invention as defined by the appended claims.

We claim:

1. A system for use with a consumable beverage, the system comprising:

a container having a mouth;

a lid detachably engagable with the container, the lid including a drinking spout attached thereto, the drinking spout providing a generally rigid and nondeformable member for drinking of the consumable beverage therethrough, the drinking spout being moveable between a first position, in which the consumable beverage can flow from the container, and a second position, in which the consumable beverage is secured within the container;

a thermal energy storing member removably locatable within the container proximate to the mouth, the thermal energy storage member having a central longitudinal axis and being adapted to contain a thermal energy storage material;

wherein the thermal energy storing member is positioned such that the drinking spout is aligned with the central longitudinal axis of the thermal energy storing member when the thermal energy storing member is located within the container, the thermal energy storing member having a generally solid, continuous outer surface that defines an outer perimeter of the thermal energy storing member such that the consumable beverage moves around the outer perimeter of the thermal energy storing member until the consumable beverage is proximate to the lid; and a liquid passageway providing a conduit for the consumable beverage to flow from within the container to the drinking spout, the liquid passageway having a cross section formed by and having a consumable beverage contacting surface formed by both an outer surface of the thermal energy storing member and the portion of the lid that receives the thermal energy storing member, wherein the outer surface of the thermal energy storing member and the portion of the lid contact the consumable beverage in the liquid passageway .

2. The system of claim 1, wherein the thermal energy storing member includes a collar located at one end thereof, the collar being positionable proximate to the mouth of the container.

3. The system of claim 2, wherein the collar includes at least one liquid passageway therethrough that is adapted to allow the consumable beverage to flow from the container, through the collar, and to the drinking spout.

4. The system of claim 2, wherein the collar has a larger cross-sectional area, as taken perpendicularly to the longitudinal axis, than the thermal energy storing member.

5. The system of claim 4, wherein a cross-section of the thermal energy storing member, as taken generally perpendicularly to the longitudinal axis, has a generally circular shape.

6. The system of claim 4, wherein at any point along a length of the thermal energy storing member a cross-section, as taken generally perpendicularly to the longitudinal axis, has a generally circular shape.

7. The system of claim 6, wherein the drinking spout is a pull top.

8. The system of claim 2, wherein the one end of the thermal energy storing member forms a plug that substantially occupies all of the mouth of the container.

9. The system of claim 8, wherein the plug is porous to allow the consumable beverage to occupy a chamber defined by the one end of the plug and an inner surface of the lid.

10. A system for use with a consumable beverage, the system comprising:

a container having a mouth;

a lid detachably engagable with the container, the lid having a drinking spout attached thereto that provides a generally rigid and nondeformable member for drinking consumable beverage therefrom, the drinking spout being moveable between a first position, in which the consumable beverage can flow from the container, and a second position, in which the consumable beverage is secured within the container;

a thread extending along a portion of an inner surface of the lid;

a thermal energy storing member detachably engagable with the opening in the lid;

wherein the thermal energy storing member detachably engages the thread so that the thermal energy storing member can be securely engaged with the lid by inserting an end of the thermal energy storing member into the portion of the lid and laterally twisting the thermal energy storing member to secure the thread in the recess; and a liquid passageway providing a conduit for the consumable beverage to flow from within the container to the drinking spout, the liquid passageway having a cross section formed by and having a consumable beverage contacting surface formed by both an outer surface of the thermal energy storing member and the portion of the lid that receives the thermal energy storing member, wherein the outer surface of the thermal energy storing member and the portion of the lid contact the consumable beverage in the liquid passageway.

11. The system of claim 10, further comprising a collar adapted to be seated in the mouth of the container, the collar defining an opening therein, wherein the thermal energy storing member has at least one groove adapted to form, in combination with the collar, a liquid passageway through the collar.

12. The system of claim 11, wherein the collar defines at least one vent therethrough to create a second liquid passageway therethrough.

13. The system of claim 10, wherein an end of the thermal energy storing member is attachable to the lid such that a central, longitudinal axis of the thermal energy storing member is aligned with an opening through which consumable beverage can be consumed.

14. A method of providing a chilled consumable beverage, comprising the steps of:

providing a container and a lid, the container having a mouth and a cavity adapted to receive the consumable beverage, the lid having a drinking spout attached thereto, the drinking spout being a generally rigid and nondeformable member and being moveable between a first position, in which the consumable beverage can flow from the container, to a second position, in which the consumable beverage is secured within the container;

placing a consumable beverage in the container;

chilling a thermal energy storing member having a central longitudinal axis extending through a solid, generally continuous outer surface, and an outer perimeter and a first end;

attaching the thermal energy storage member to a lid configured to engage the container such that the thermal energy storage member and the lid form a liquid passageway providing a conduit for the consumable beverage to flow from within the container toward the drinking sprout, the conduit having a cross section formed by and having a consumable beverage contacting surface formed by both an outer surface of the thermal energy storing member and the portion of the lid that receives the thermal energy storing member, wherein the outer surface of the thermal energy storing member and the portion of the lid contact the consumable beverage in the liquid passageway; and inserting the chilled thermal energy storing member into the container such that the chilled thermal energy storing member contacts the consumable beverage to cool the consumable beverage within the container, the chilled thermal energy storing member being securely positionable within the container with the first end located proximate to the mouth of the container such that the drinking spout is aligned with the central longitudinal axis, the solid, generally continuous outer perimeter of the thermal energy storing member guides the consumable beverage along the outer surface outside of the outer perimeter of the thermal energy storing member at least until the consumable beverage is generally proximate to the mouth of the container.

15. The method of claim 14, further comprising the step of securing a lid over the mouth that also secures a collar, that is detachably engaged with the thermal energy storing member, in the seated position.

16. The method of claim 14, further comprising the step of inserting the chilled thermal energy storing member within an opening in a collar such that a liquid passageway along the chilled energy storing member and through the collar is formed.

17. The method of claim 14, further comprising providing a collar that is detachably engageable with the thermal energy storing member, the collar having at least one vent therethrough to form a second liquid passageway through the collar, the at least one vent being spaced from the opening.

18. A system for use with a consumable beverage, the system comprising:

a container having a mouth;

a lid detachably engagable with the mouth of the container, the lid including a drinking spout adapted for drinking of the consumable beverage therethrough;

a collar removably secured between and held in place by the mouth of the container and the lid;

a thermal energy storing member, having a central longitudinal axis and being adapted to contain a thermal energy storage material, having an end which is detachably engagable with the collar; and a liquid passageway extending through the collar, the liquid passageway providing a conduit for the consumable beverage to flow past the collar toward the drinking spout, the conduit having a cross section formed by and having a consumable beverage contacting surface formed by both an outer surface of the thermal energy storing member and the portion of the collar that receives the thermal energy storing member, wherein the outer surface of the thermal energy storing member and the portion of the collar contact the consumable beverage in the liquid passageway.

19. The system of claim 18, wherein the collar includes at least one opening and at least one thread in the at least one opening, and the end of the thermal energy storing member includes at least one groove for receiving the at least one thread.

20. The system of claim 18, wherein the collar includes at least one opening, and wherein the end of the thermal energy storage member is engagable with the opening of the collar.

21. The system of claim 18, wherein the collar contacts the mouth of the container and the lid.

22. The system of claim 18, wherein the collar has a larger cross-sectional area, as taken perpendicularly to the longitudinal axis, than a cross-sectional area of the thermal energy storing member taken perpendicularly to the longitudinal axis.

23. A method of providing a drink bottle capable of one of chilling and heating a consumable beverage, comprising the steps of:

providing a container and a lid, the container having a mouth disposed proximate a top of the container and having an inner wall defining a cavity configured to receive the consumable beverage, the lid having a drinking spout attached thereto, the drinking spout being a generally rigid and nondeformable member and being moveable between a first position, in which the consumable beverage can flow from the container through the drinking spout, to a second position, in which the consumable beverage is secured within the container;

providing a thermal energy storing member containing a refreezeable material therein, the thermal energy storing member having a central longitudinal axis, an outer surface, an outer perimeter, and a first end;

attaching the thermal energy storage member to a lid configured to engage the container such that the thermal energy storage member and the lid form a liquid passageway providing a conduit for the consumable beverage to flow from within the container toward the drinking spout, the conduit having a cross section formed by and having a consumable beverage contacting surface formed by both an outer surface of the thermal energy storing member and the portion of the lid that receives the thermal energy storing member, wherein the outer surface of the thermal energy storing member and the portion of the lid contact the consumable beverage in the liquid passageway; and inserting the thermal energy storing member into the container such that the thermal energy storing member is adapted to contact consumable beverage therein to one of heat and cool the consumable beverage, the thermal energy storing member being securely positionable within the container with the first end located proximate to the mouth of the container such that the drinking spout is aligned with the central longitudinal axis of the thermal energy storing member, the thermal energy storing member being configured so that any consumable beverage generally flows outside of the outer perimeter thereof so that the consumable beverage is generally between the inner wall of the container and the outer surface that defines the outer perimeter of the thermal energy storing member until the consumable beverage is proximate to the mouth of the container so that the consumable beverage is generally drawn from the cavity proximate to the top of the bottle.

24. A system for use with a consumable beverage, the system comprising:

a container having a mouth proximate a top thereof;

a lid detachably engagable with the container, the lid having a drinking spout attached thereto that provides a generally rigid and nondeformable member for drinking consumable beverage therefrom, the drinking spout being moveable between a first position, in which the consumable beverage can flow from the container, and a second position, in which the consumable beverage is secured within the container;

a thread extending along a portion of an inner surface of the lid;

a thermal energy storing member detachably engagable with the opening in the lid, wherein the thermal energy storing member detachably engages the thread so that the thermal energy storing member can be securely engaged with the lid by inserting an end of the thermal energy storing member into the portion of the lid and laterally twisting the thermal energy storing member to secure the thread in the recess; and a liquid passageway extending between the cavity at a location proximate the top of the container and the dispensing spout, the liquid passageway providing a conduit for the consumable beverage to flow from within the container to the drinking spout, the conduit having a cross section formed by and having a consumable beverage contacting surface formed by both an outer surface of the thermal energy storing member and the portion of the lid that receives the thermal energy storing member, wherein the outer surface of the thermal energy storing member and the portion of the lid contact the consumable beverage in the liquid passageway.

* * * * *